United States Patent [19]

Strindehag et al.

[11] 4,189,330

[45] Feb. 19, 1980

[54] METHOD FOR MAKING HUMIDITY AND HEAT EXCHANGER APPARATUS

[75] Inventors: Ove Strindehag; Erik Wrangel, both of Jonkoping, Sweden

[73] Assignee: AB Svenska Flaktfabriken, Nacka, Sweden

[21] Appl. No.: 789,149

[22] Filed: Apr. 20, 1977

Related U.S. Application Data

[63] Continuation-in-part of Ser. No. 651,589, Jan. 22, 1976, Pat. No. 4,038,059.

[30] Foreign Application Priority Data

Jan. 30, 1975 [SE] Sweden ..... 7500987
Nov. 24, 1975 [SE] Sweden ..... 7513148

[51] Int. Cl.[2] ..... C23C 1/08; C23F 7/00

[52] U.S. Cl. ..... 148/6.27; 148/6.3; 338/35; 427/126

[58] Field of Search ..... 134/2; 148/6.27, 6.2, 148/6.3; 427/126; 338/35; 55/390

[56] References Cited

U.S. PATENT DOCUMENTS

| | | | |
|---|---|---|---|
| 2,991,204 | 7/1961 | Astle | 148/6.27 |
| 3,380,860 | 4/1968 | Lipinski | 148/6.27 |
| 3,391,012 | 7/1968 | Mitchell et al. | 148/6.27 |
| 3,440,372 | 4/1969 | Cecil | 338/35 |
| 3,455,746 | 7/1969 | Kong | 148/6.27 |
| 3,531,332 | 9/1970 | Scott et al. | 148/6.27 |
| 3,733,791 | 5/1973 | Draunieks | 55/390 |
| 3,846,182 | 11/1974 | Huff et al. | 148/6.2 |
| 3,861,031 | 1/1975 | Furiuchi | 148/6.27 |
| 3,871,881 | 3/1975 | Mikelsons | 148/6.27 |
| 3,905,838 | 9/1975 | Ito | 148/6.27 |
| 3,935,349 | 1/1976 | Terai et al. | 148/6.27 |
| 3,987,676 | 10/1976 | Bennewitz | 338/35 |
| 3,989,550 | 11/1976 | Newhard | 148/6.27 |
| 4,007,063 | 2/1977 | Yasuda et al. | 148/6.3 |
| 4,028,205 | 6/1977 | Dorsey | 148/6.27 |

FOREIGN PATENT DOCUMENTS

| | | | |
|---|---|---|---|
| 1042263 | 9/1966 | United Kingdom | 148/6.27 |

*Primary Examiner*—S. Leon Bashore
*Assistant Examiner*—George C. Yeung
*Attorney, Agent, or Firm*—Howson and Howson

[57] ABSTRACT

The transfer elements of a heat and humidity exchanger are made by forming the transfer elements in the desired configuration and of a non-hygroscopic metal such as aluminum, and treating the surfaces to produce an integral hygroscopic layer thereof. This is done by oxidizing the surface of the metal to form an oxide layer, which itself is hygroscopic, and preferably enhancing the hygroscopic properties by subsequent impregnation of the oxide with a hygroscopic material such as lithium chloride. According to one form of the method, the oxidizing layer is produced by immersing the transfer elements, in a bath such as a warm aqueous solution of sodium hydroxide, or sodium carbonate, followed by heating in humid air; in a second form of the method, the oxide layer is produced by heating in humid air, or in a water, without preliminary alkaline treatment; in a third form of the method, the oxide layer is formed in a water bath containing an oxidizing agent such as trietanolamin or hydrogen peroxide. When preliminary alkaline treatment is used, it is preferably followed by an acid treatment prior to heating. In any of these methods, the oxidation step is preferably preceded by an acid treatment to render the surfaces of the transfer elements more porous.

6 Claims, 3 Drawing Figures

METHOD FOR MAKING HUMIDITY AND HEAT EXCHANGER APPARATUS

BACKGROUND OF THE INVENTION

This application is a continuation-in-part of U.S. patent application Ser. No. 651,589 of Ove Strindehag and Erik Wrangel, filed Jan. 22, 1976 and issued July 26, 1977 as U.S. Pat. No. 4,038,059.

This invention relates to method for making humidity and heat exchangers, particularly those of the regenerator type.

Regenerative heat exchangers have long been used to recover heat in ventilation installations because such heat exchangers exhibit a comparatively high degree of thermal efficiency. Regenerative heat exchangers in addition can achieve an effective transfer of humidity, which can be especially valuable in zones with a cold climate. The most frequently used type of regenerative heat exchanger hitherto used in ventilation installations to transfer heat from the warm discharge air flow to the cold intake air flow is a rotating heat exchanger with a disc-shaped rotor. The heat exchanger rotor is usually constructed of alternating flat and corrugated metal, paper cardboard or asbestos panels or foils. In another standard model, the rotor is constructed of a three dimensional network of metal wires.

In the case of rotating heat exchangers whose heat exchange body consists of panels or a network made of non-hygroscopic material, for example of metal, humidity transfer hitherto came about only as a consequence of water vapor condensation. Such heat exchangers thus accomplish a less efficient transfer of humidity than exchangers constructed of hygroscopic material, for example paper or asbestos. However, heat exchangers with metal rotors possess the clear advantage over rotors made of paper or the like, in that they are fire-proof and further because the use of metals in ventilation installations is, for medical reasons, preferable to the use of asbestos.

The object of the present invention thus is to provide a regenerative humidity and heat exchanger which is fire-proof and safe from a medical point of view, and which possesses efficient heat and, especially, humidity, transfer characteristics.

This task is accomplished by the regenerative humidity and heat exchanger of our above-cited patent application, and by the manufacturing method of the present invention described in the following detailed description and covered by the appended claims. The invention results in the simple and reliable manufacture of apparatus providing an efficient transfer of humidity without jeopardy to fire safety or to medical requirements.

SUMMARY OF THE INVENTION

According to the invention there is provided a method of making transfer elements for a humidity and heat exchanger, comprising forming the transfer elements in a desired configuration and of a non-hygroscopic material, and treating the surfaces of the formed transfer elements to produce an integral hygroscopic surface layer thereon. This is accomplished by a treatment which forms a layer of oxide of the non-hygroscopic material on the surface thereof, which layer is itself hygroscopic but may be impregnated with a highly hygroscopic material such as lithium chloride to enhance its hygroscopic properties. The oxidation is preferably accomplished in one embodiment by immersing of the surfaces in an alkaline solution, for example in a warm aqueous solution of sodium hydroxide or sodium carbonate followed by heating, preferably in humid air. In a second embodiment the oxide layer is produced by heating, preferably in humid air or in warm water without preliminary alkaline treatment; in a third embodiment, the oxidation is accomplished by immersion in water containing an oxidizing agent such as trietanolamin or hydrogen peroxide. When preliminary alkaline treatment is used, it is preferably followed by application of one or more acids, for example an aqueous solution of HCl.

DETAILED DESCRIPTION OF SPECIFIC EMBODIMENTS

A heat exchanger body according to the invention, can be constructed in a number of different ways. The application of the surface treatment process involved in preferred forms of the invention will be described herein by way of example only in connection with a usual case in which the heat exchanger body consists of a rotor constructed of alternating flat and corrugated foils joined together by glue or by adhesives. This embodiment is evident from FIGS. 1–3 wherein.

If, besides other factors, we consider weight, workability and durability in humid air, then aluminum is a suitable metal for heat exchanger construction and the surface treatment process described in this connection thus applies especially to aluminum or to aluminum alloy. But it is also stressed that the invention is in no case limited to these materials, and that the idea of the invention, and the following patent claims, include also any other suitable non-hygroscopic rotor material. We further assume by way of example that flat or corrugated panels, foils etc. are used for the construction of the heat exchanger body which, being furnished with special spacing arrangements, creates continuous channels leading through it. By treating the flat and/or corrugated foils or the like on both sides, the area of the humidity transfer surface of the heat exchanger body becomes equal to that of the heat exchange surface which means that only small amounts of humidity need be adsorbed or released per unit of area. Normally humidity is absorbed in a warm, and released in a cold, air stream. The circumstance that the amounts of humidity transferred per unit area can be small permits the use of thin hygroscopic layers on a non-hygroscopic substrate, e.g. an aluminum panel or foil.

Figure 1:
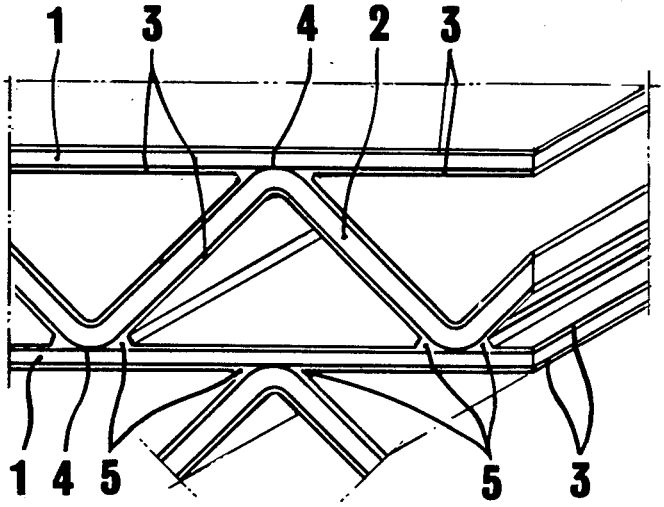
FIG. 1 is an enlarged fragmentary side view of a portion of the rotor of FIG. 3, constructed of alternating flat and corrugated foils.
Figure 2:
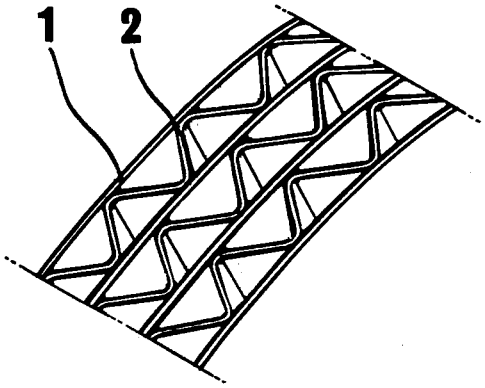
FIG. 2 is a less-enlarged fragmentary view of a larger segment of the same rotor.
Figure 3:
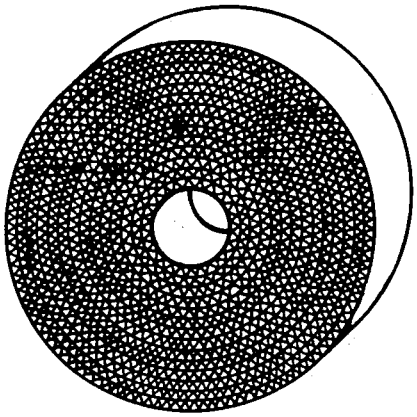
FIG. 3 is a perspective view of the entire rotor.

FIG. 1 reveals that the flat foils 1 and the corrugated foils 2 are coated on both sides with the surface layer 3. The flat foils were glued to the corrugated ones at contact points 4, yielding a mechanically stable rotor. In the case of the model shown it is assumed that the surface treatment took place after the assembly of the heat exchanger body, which is why no surface layer formed on the parts of the foils where joints 5 are glued on. Usually very compact rotor structures are chosen for rotating heat exchangers, and rotors constructed of alternating flat and corrugated foils are so spaced that the distance between the center lines of the flat foils is usually 1–3 mm. The flat and corrugated foils are usually 0.05–0.2 mm. thick.

The following are specific examples of how the invention may be practiced.

EXAMPLE 1

A rotor of aluminum is formed to the configuration shown in the figures. (a) The rotor is then immersed in an aqueous bath of HCl for about 20 minutes to render the surface porous. (b) The rotor is then removed, rinsed in water, and immersed in a bath of 1% aqueous NaOH for about 5 minutes at about 40° C. to form an aluminum oxide layer on the surfaces of the aluminum rotor. (c) It is then promptly immersed in a 5% aqueous bath of HCl to arrest the NaOH action. (d) The rotor is then promptly heated to about 110° C. in air having a relative humidity of about 30% for 30 minutes to increase the thickness of the oxide layer. (e) The rotor is then immersed in a weak aqueous solution of lithium chloride (2%) for about 3 minutes to impregnate it with lithium chloride and thereby further enhance the hygroscopic properties of the integral surface aluminum oxide layer.

As variations of Example 1, in step (a) above the HCl concentration may typically range from about 2% to 10%, and one or more other acids in addition to or in place of HCl may be used. Also a mixture of HCl and a solution of NaCl can be used. In step (b) above, the NaOH concentration may typically range from about 0.2% to about 10%; one may also use a different alkaline bath material, for example sodium carbonate in aqueous solution in a concentration typically of from about 1% to about 10%. The preferred temperature range for the alkaline bath is from about 25° C. to about 75° C. In step (c) above, the arrest may be provided by HCl solution mixed with one or more other acids, or one or more other acids may be used in place of HCl solution. In step (d) above, other relative humidities above 10%, and other temperatures above about 50° C., may be used. In step (e) above, other hygroscopic salts may be used in place of lithium chloride.

As further variations of Example 1, one can omit any or all of steps (a), (c), and (e) while still obtaining an oxide layer useful in some cases, but step (a) increases the oxide layer thickness, step (c) adds to the reliability and reproducibility of the process, and step (e) generally increases the hygroscopic properties obtained.

EXAMPLE 2

In this example the preliminary alkaline treatment is omitted, and the oxide layer formed by heating alone. The rotor may be first subjected to the pore-forming treatment as described in (a) of Example 1 and its variations. It is then rinsed in water and heated at about 110° C. for about 30 minutes in air having a relative humidity of about 30%. The resultant oxide layer is of usable thickness and of useful hygroscopic properties. However, impregnation with a hygroscopic salt may then be performed if desired for the particular application.

As variations of Example 2, the temperature may be varied through a substantial range, typically above 50° C. however, and the relative humidity may also be varied from the value mentioned, but is preferably greater than 10%. As a further alternative, the heating may be performed with the rotor surfaces immersed in water, the temperature typically being at least 35° C. in such a case.

EXAMPLE 3

In this example, the aluminum rotor is immersed in water containing 5% triethanol amine or 1% hydrogen peroxide for about 50 minutes at about 80° C., to produce a hygroscopic aluminum oxide layer on the surfaces of the rotor.

In Example 3 the trietanolamin or hydrogen peroxide bath may vary from about 0.5% to 10%; typical temperatures are in the range of about 40° C. to about 90° C.. Also water solutions of other oxidizing agents can be used.

The oxidation of Example 3 may be used in combination with the porosity-enhancing pretreatment and/or the subsequent impregnation with a hygroscopic salt, these steps being described above in Example 1.

Accordingly, while the invention has been described in detail with respect to specific embodiments in the interest of complete definiteness, it will be understood that it can be embodied in a variety of forms diverse from those specifically shown and described, without departing from the spirit and scope of the invention as reflected in the appended claims.

What is claimed is:

1. In the method of making a regenerative humidity and/or heat exchanger having transfer elements for transporting moisture between two different bodies of air, the steps of:

forming said transfer elements of non-hygroscopic aluminum or alloys thereof;

subjecting the surfaces of said transfer elements to an oxidizing treatment including immersing said surfaces of said transfer elements in an aqueous solution of sodium hydroxide or sodium carbonate and heating said elements to convert said surfaces to an integral hygroscopic layer of oxide of aluminum;

wherein said treatment comprises impregnating said layer with a hygroscopic salt.

2. The method of claim 1, wherein said salt is lithium chloride.

3. The method of forming an integral hygroscopic layer of oxide of aluminum on the surfaces of aluminum transfer elements of a humidity and/or heat exchanger, comprising:

(a) initially rendering said surfaces porous by immersing said surfaces in an aqueous acidic bath;

(b) then, chemically forming an aluminum oxide layer on and from said surfaces by immersing them in an alkaline solution consisting essentially of sodium hydroxide, sodium carbonate or mixtures thereof heated to a temperature of from about 25° C. to about 75° C.; and (c) thereafter heating said surfaces in an environment consisting essentially of water or water and air to increase the thickness of said aluminum oxide layer and render it highly hygroscopic.

4. The method of claim 3, wherein said last-named heating is to above 100° C. in air having a humidity of at least about 30%.

5. The method of claim 4, wherein:

said initial immersing in an aqueous acidic bath comprises conducting said immersing for at least about 20 minutes;

said immersing in alkaline solution comprises immersing in NaOH of a concentration of about 1% for about 5 minutes at about 40° C.; and said heating is to about 110° C.

6. The method of claim 3, wherein said last-named heating is in a water bath maintained at a temperature above 35° C.

* * * * *